United States Patent [19]

Sackin et al.

[11] 4,082,164

[45] Apr. 4, 1978

[54] ELEVATOR SYSTEM

[75] Inventors: Milton Sackin, Pittsburgh; George T. Hummert, Oakmont, both of Pa.

[73] Assignee: Westinghouse Electric Corporation, Pittsburgh, Pa.

[21] Appl. No.: 463,695

[22] Filed: Apr. 24, 1974

[51] Int. Cl.[2] ..... B66B 1/22

[52] U.S. Cl. ..... 187/29 R

[58] Field of Search ..... 187/29

[56] References Cited

U.S. PATENT DOCUMENTS

| | | | |
|---|---|---|---|
| 2,840,189 | 6/1958 | Santini et al. | 187/29 |
| 3,236,332 | 2/1966 | Burgy et al. | 187/29 |
| 3,506,094 | 4/1970 | Hall et al. | 187/29 |
| 3,589,473 | 6/1971 | Kirsch et al. | 187/29 |
| 3,731,765 | 5/1973 | Robaszkiewicz | 187/29 |
| 3,739,880 | 6/1973 | Robaszkiewicz | 187/29 |
| 3,743,057 | 7/1973 | Hall et al. | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

A new and improved elevator system, and method of directing a plurality of elevator cars to serve floor calls in an elevator system. Service is provided for floor calls which cannot be allocated to a suitably conditioned car already busy serving calls, by specifically assigning non-busy or available cars to serve such calls. The floor calls are each timed from registration and when their registration time reaches a first value the strategy for assigning available cars to non-allocated calls is changed. The timing of a call continues following the reaching of the first value, until the call reaches a second timed value. The strategy for assigning available cars to non-allocated calls is changed again, in response to a call registered for the second predetermined period of time.

23 Claims, 13 Drawing Figures

ELEVATOR SYSTEM

BACKGROUND OF THE INVENTION

1. Field of the Invention

The invention relates in general to elevator systems, and more specifically to elevator systems in which a plurality of elevator cars are controlled to answer certain floor calls according to predetermined strategies.

2. Description of the Prior Art

Various control arrangements have been used in an attempt to provide more equitable elevator service to all floors of a building during the various traffic conditions encountered throughout a typical day. Elevator cars have been assigned to specific hall calls, or groups of hall calls, with the priority in assigning a specific call to a car being based on the order or registry of the call. Thus, the relative waiting times of the calls establishes the priority, rather an absolute time value. U.S. Pat. Nos. 2,104,478 and 2,104,522 assign an elevator car to a predetermined number of hall calls, with the calls assigned being based on the order of registry. U.S. Pat. No. 3,371,747 selects a predetermined number of hall calls, by order of registration, as priority calls, and assigns elevator cars thereto. U.S. Pat. No. 3,561,571 gives certain cars a special status, and these special status cars respond only to a call having a high priority, based on the order of registration. U.S. Pat. No. 3,645,361 selects the longest wait call for priority, based on order of registration.

In addition to keeping track of call registration order, timers have also been used to time the registration time of hall calls in order to determine when calls should receive certain predetermined priority treatment. For example, elevator cars which are busy answering calls for elevator service may treat hall calls differently as a function of the total time registered and the specific condition of the elevator car. In U.S. Pat. No. 2,347,054, an elevator car will stop for a short term call if it is on schedule and has not already accepted a predetermined number of hall calls to answer, and as it falls behind schedule and/or accepts more hall calls, it will stop for only calls registered for a medium, or a long term, depending upon how far behind schedule and/or how many calls it has accepted. In U.S. Pat. No. 2,624,425 the duration of a hall call necessary to stop a car varies as a function of car load. In U.S. Pat. No. 3,256,958, zones of one or more floors are established, and if there are more down zones requiring service then down running cars in position to serve the calls, a demand is created for the zone of the call, to which a car is assigned when one becomes available. If the demand exists for a predetermined period of time, it becomes a higher priority demand to which a car will be assigned regardless of the number of down calls and down running cars.

U.S. Pat. No. 3,256,958 further assigns available cars to a plurality of down demands, none of which are timed out, by assigning the first car to the highest down demand, and, until this highest down demand call is canceled, subsequent cars are assigned to the demand which represents the midpoint of the remaining unassigned down zone demands. Should a down zone demand become timed out, it receives preference over non-timed out demands, and if there are more than one timed out demand, the highest timed out demand is assigned first.

British Patent 931,301 times the calls in down zones, and sends available cars to zones and/or calls in the zone, on the basis of total lengths of time the zone demand or floor call has been registered. U.S. Pat. No. 3,506,094 selects the oldest call for priority service. Inhibiting all the call timers should one reach a predetermined maximum value, to retain the relative priorities of the calls.

SUMMARY OF THE INVENTION

Briefly, the present invention is a new and improved elevator system which improves upon the strategy of U.S. Pat. No. 3,256,958, which is assigned to the same assignee of the present application, in the handling of down floor calls after they have been registered for a predetermined period of time. After each down floor call is registered, an attempt is made to allocate the call to a suitably conditioned elevator car already busy with the task of serving calls for elevator service. If the floor call cannot be so allocated, the call becomes a demand call, to which an available or non-busy car will be specifically assigned. The floor calls are timed as soon as they are stored in the call record, and should the call exist for a first predetermined period of time, the strategy utilized for assigning available cars changes. Insread of assigning available cars to demand calls according to a strategy which is based upon the location of the calls in the building, available cars are assigned only to those calls which have been registered for the first predeteremined period of time. The timers for the calls are not stopped when the first predetermined period of time is reached, and the available cars are assigned to these first period calls on the basis of total time registered. Should one or more first period calls be registered for a second predetermined period of time, the strategy is again changed. Instead of assigning available cars only to first period calls with a priority based on total registration time, available cars are assigned only to those calls registered for the second predetermined period of time, with the priority being based on the locaton of these calls in the building. An available car is assigned to the highest of such second period calls in the structure, and until this highest call is canceled, successive available cars are assigned to the call which represents the midpoint of the remaining unassigned second period calls.

In a preferred embodiment of the invention, the call table of hall calls is ordered to start the highest call in the building at one end thereof, the next highest second, etc. The table is processed one call at a time starting from this end. The first second period call encountered immediately stops the processing of the call table, to assign an available car to this call. If the highest second period call in the structure encountered has already been assigned during a previous processing of the call table, the complete call table is processed to count the number of unassigned second period calls, and to locate the longest registered first period call. If there are any unassigned second period calls, the second period call strategy is implemented. If there are no second period calls, the longest registered first period call is assigned.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
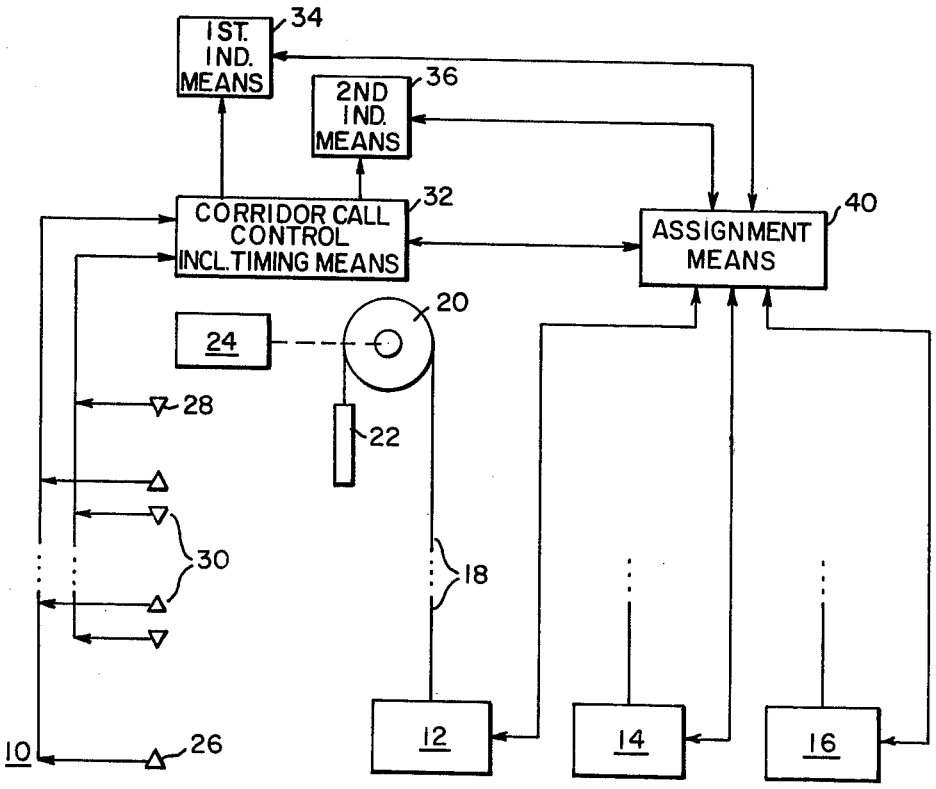
FIG. 1 is a diagrammatic representation of an elevator system which may be constructed according to the teachings of the invention.

Referring now to the cdrawings, and FIG. 1 in particular, there is shown an elevator system 10 constructed according to the teachings of the invention. In order to simplify the description, the elevator system 10 is shown in block form. U.S. Pat. No. 3,750,850 and application Ser. Nos. 340,618 (now U.S. Pat. No. 3,804,209) and 340,619 filed Mar. 12, 1973, which are all assigned to the same assignee of the present application, collectively describe a complete elevator system which may utilize the teachings of the invention, and they are hereby incorporated into this application by reference. U.S. Pat. No. 3,750,850 discloses control for operating a single elevator car, without regard to operation of the car in a bank of cars, and application Ser. Nos. 340,618 and 340,619 disclose the control necessary to operate a plurality of elevator cars in a bank under the direction of a programmable system processor.

More specifically, elevator system 10 includes a plurality of elevator cars, such as elevator cars 12, 14 and 16, each disposed in the hatchway of a building having a plurality of landings of floors. The elevator cars are mounted for movement in their respective hatchways of the building to serve the floors therein, such as illustrated for elevator car 12. Elevator 12 is supported by a rope 18 which is reeved over a traction sheave 20. A counterweight 22 is connected to the other end of the rope 18. Sheave 20 is driven by a suitable drive motor 24, such as a direct current motor as used in the Ward-Leonard drive system, or in a solid state drive system.

Corridor or floor calls are registered by pushbuttons mounted at the various floors or landings, such as by an up direction pushbutton 26 located at the first landing, a down direction pushbutton 28 located at the top landing, and up and down direction pushbuttons 30 located at the intermediate landings. These floor calls are recorded, serialized, and timed in corridor call control 32. If a given corridor call is registered for a first predetermined period of time, typically 40 seconds, this fact is noted by the first indicating means 34. The timing of each call is continued, after it has been registered for the first predetermined period of time, at least until the call has been registered for a second predetermined period of time, typically a total time in the range of 80 to 120 seconds. When a call is registered for the second predetermined period of time, this fact is noted by second indicating means 36. In the preferred embodiment of the invention, the call timers are binary counters. When a corridor call is received, its counter is set at some positive number, and this positive number is decremented at predetermined time intervals. The first predetermined period of time occurs when the counter goes negative. The counter continues to count and the second predetermined period of time is when the counter reaches or exceeds a predetermined negative number, after which time the counter need not be decremented any further. The number of bits in the counter, the decrementing interval, and the desired first and second time intervals may be selected such that the second time interval is signified by overflow of the associated binary counter.

The serialized corridor calls from corridor call control 32 are directed to a system processor, referred to herein as assignment means 40, and signals provided by the first and second indicating means 34 and 36 may also be sent to assignment means 40 to indicate when calls reach the first and second time intervals; or, the assignment means may merely check the indicator means 34 and 36, as required, depending upon the specific control arrangement utilized.

As described in the incorporated applications, the programmable system processor attempts to allocate a corridor call to a suitably conditioned elevator car which is already busy serving car or corridor calls, with this function occurring in a subprogram ACL. In the event a call cannot be allocated to a busy elevator car, the call becomes a a demand call. If there is a demand call and there is an available car, i.e., an in-service car not presently serving a call for elevator service, subprogram ACR assigns an available car to this demand call. The floor selector for each elevator call provides an available signal AVAS for the system processor when its associated car is in service, not running or decelerating, and its doors are closed. The system processor then makes its decision as to whether or not the car is available for demand assignments, providing a signal AVAD when it is available for such an assignment. The present application is related to new and improved strategy for assigning available cars to demand calls, and especially to demand calls for service in the down direction which are "timed out", i.e,., registered for predetermined different periods of time.

Figure 2:
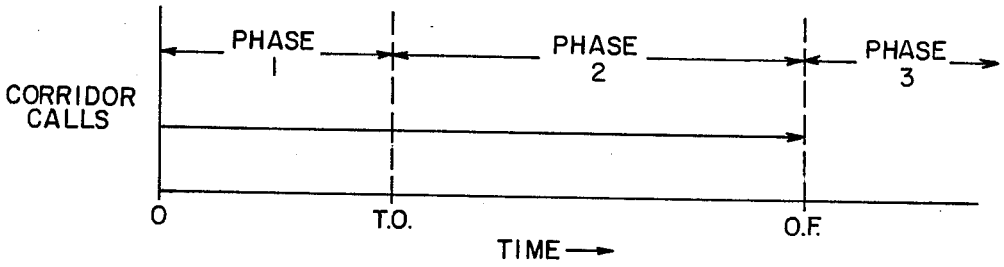
FIG. 2 is a chart which illustrates the timing of a corridor call according to the teachings of the invention.

FIG. 2 is a chart which illustrates the timing of a corridor call according to the teachings of the invention. When a corridor call is added to the call table CL by subprogram TNC its zone is set and its timer is set. The setting of the timer corresponds to time zero in FIG. 2. The call is then what will be referred to as a phase 1 call, until it is registered for a first predetermined period of time, which is the normal period chosen to make a call "special", such as 40 seconds. This time is referred to as "T.O." in FIG. 2, indicating the call is timed out. When a call reaches the timed out value, it is still timed, and it then becomes a phase 2 call. The call remains a phase 2 call until it has been registered for a second predetermined period of time, which typically will be a total time, starting from registration, which is two to three times longer than the first predetermined period of time. At the end of the second predetermined period of time, it is no longer necessary to time the call, and once it reaches this second predetermind period of time it becomes a phase 3 call. If a binary counter or timer is used, this second predetermined period may be signified by the counter overflowing, and this time is indicated accordingly in FIG. 2 by "O.F."

Figure 3:
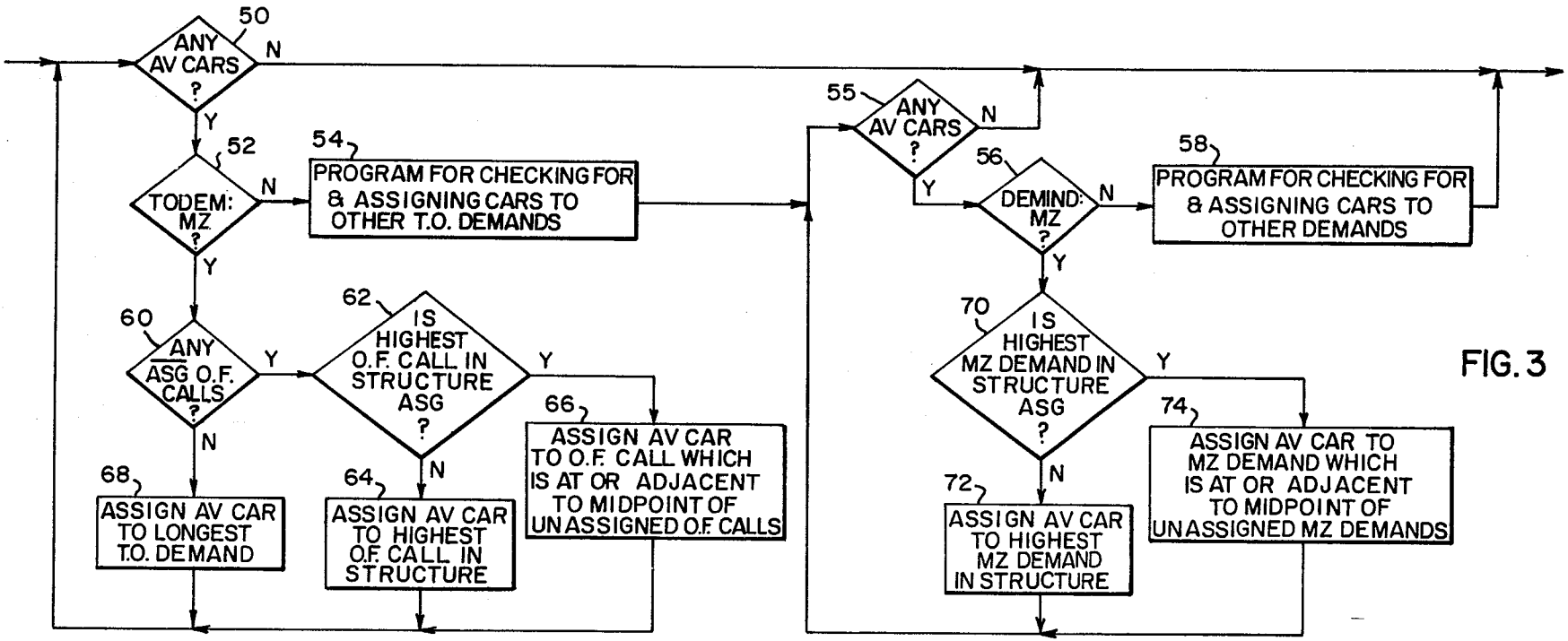
FIG. 3 is a flow diagram broadly illustrating the strategy in answering down demand floor calls according to the teachings of the invention.

FIG. 3 is a flow chart which broadly illustrates a method of assigning elevator cars to demand calls according to the teachings of the invention. Step 50 determins if there are any AVAD cars, i.e., cars which are available according to the system processor for assignment to a demand call. If there are none, it is unnecessary to determine if there are any demands, and the program simply goes on to other tasks. If there is an available car, step 52 checks for a timed out demand (TODEM) in the main zone (MZ). A timed out demand is a corridor call which has been registered for at least the first predetermined period of time. The main zone (zone 6) includes down calls from floors above the main floor. If there are no timed out down calls, step 54 checks for timed out calls in other zones, and assigns available cars to any such demands. Step 55 then determines if there are any available cars, and if none, the program returns to other tasks. If there is an available car, step 56 checks for demand calls (DEMIND) in the main zone. A main zone demand call is a phase 1 down corridor call which could not be allocated to a busy car. If there are none, step 58 checks for the presence of other types of non-timed out demands, assigns available cars to any such demand, and then returns to other tasks.

If step 52 determines that there is a timed out down corridor call, step 60 determines if there are any unassigned ($\overline{ASG}$) phase 3 (O.F.) calls.

The strategy for assigning available cars to phase 3 calls is to assign a car to the highest phase 3 down call in the building, and then, while this highest call persists as an assigned call, to successively assign additional available cars to the call which represents the midpoint of any remaining unassigned phase 3 calls. If the remaining unassigned phase 3 down calls is an odd numbered plurality, the next car is assigned to the call which is exactly at the midpoint of this odd numbered plurality. If the remaining unassigned phase 3 down calls is an even number, the calls are divided into equal upper and lower groups, and a car is assigned to the highest call of the lower group, or the lowest call of the upper group, as desired, with "highest" and "lowest" indicating positions of the calls in the structure. In a preferred embodiment of the invention, the call is assigned to the highest call of the lower group, since the highest phase 3 call has a car already assigned thereto, which may serve the lowest phase 3 call of the highest group and thus the assigned cars are equitably spaced by selecting the highest call of the lower group. When the car assigned to the highest phase 3 down call decelerates to stop at the floor of this call, this call is canceled, and the strategy then reverts to assigning the next available car to the highest unassigned phase 3 down call in the building.

This phase 3 strategy may be implemented, as shown in FIG. 3, when step 60 determines that there is an unassigned phase 3 down call, by checking in step 62 to determine if the highest phase 3 down call in the structure is assigned. If it is not, step 64 assigns the closest available car to this highest phase 3 call. If there is an available car and there are any remaining unassigned phase 3 down calls, the program will loop back through steps 50, 52, 60 and 62, and will now find that the highest phase 3 down call in the building is assigned. Step 66 then assigns an available car to the phase 3 down call which is at, or adjacent to, the midpoint of any remaining unassigned phase 3 down calls, depending upon whether the number of such remaining calls is odd or even, as hereinbefore explained. If there is still an available car and additional phase 3 down calls remain while the highest phase 3 calls is still in the assigned category, the program returns to step 66 via the loop which includes steps 50, 52, 60 and 62.

If step 52 determines that there is a timed out down call and step 60 determines there are no unassigned phase 3 down calls, the timed out demand must necessarily be due to a phase 2 down call. The strategy for assigning cars to phase 2 down call is to assign an available car to the longest registered phase 2 down call. As indicated in FIG. 2, the timing of the corridor calls continues during phase 2, so the program finds the longest registered of the calls in the phase 2 category and assigns the closest available car to this longest registered call. Step 68 implements this strategy for down corridor calls in phase 2, looping back through steps 50, 52, 60 and 68 to continue to assign available cars to the longest registered of any remaining phase 2 calls, as long as there are available cars and unassigned phase 2 calls.

Once the timed out phase 3 and phase 2 demands are taken care of, if any, phase 1 demands are handled. The strategy for phase 1 down demands involves assigning cars according to the locations of the calls in the structure, similar to the phase 3 strategy, and unlike the phase 2 strategy which assigns cars to calls based upon relative registration times of phase 2 calls. Thus, the highest unassigned phase 1 down call may be assigned to the nearest available car, and while this highest call is in the assigned category, any remaining available cars are assigned to the demand call which represents the midpoint, or a call adjacent thereto, of any remaining unassigned phase 1 down demand calls. Step 70 initiates the implementation of phase 1 strategy by determining if the highest phase 1 down call in the building is assigned. If it is not assigned, step 72 assigns the closest available car to this highest call. If there is still an available car and there is still phase 1 down calls to be assigned, the program loops back through steps 55, 56 and 70 to step 73, which assigns the nearest available car to that phase 1 down call which is at, or adjacent to, the midpoint of the remaining unassigned phase 1 down calls. The program continues to loop through steps 55, 56, 70 and 74 as long as there are available cars and unassigned phase 1 down calls. Once the highest assigned phase 1 down call is answered and thus canceled, the strategy reverts to assigning the next available car to the highest phase 1 down call in the structure, if the highest phase 1 down call is unassigned.

Figure 4:
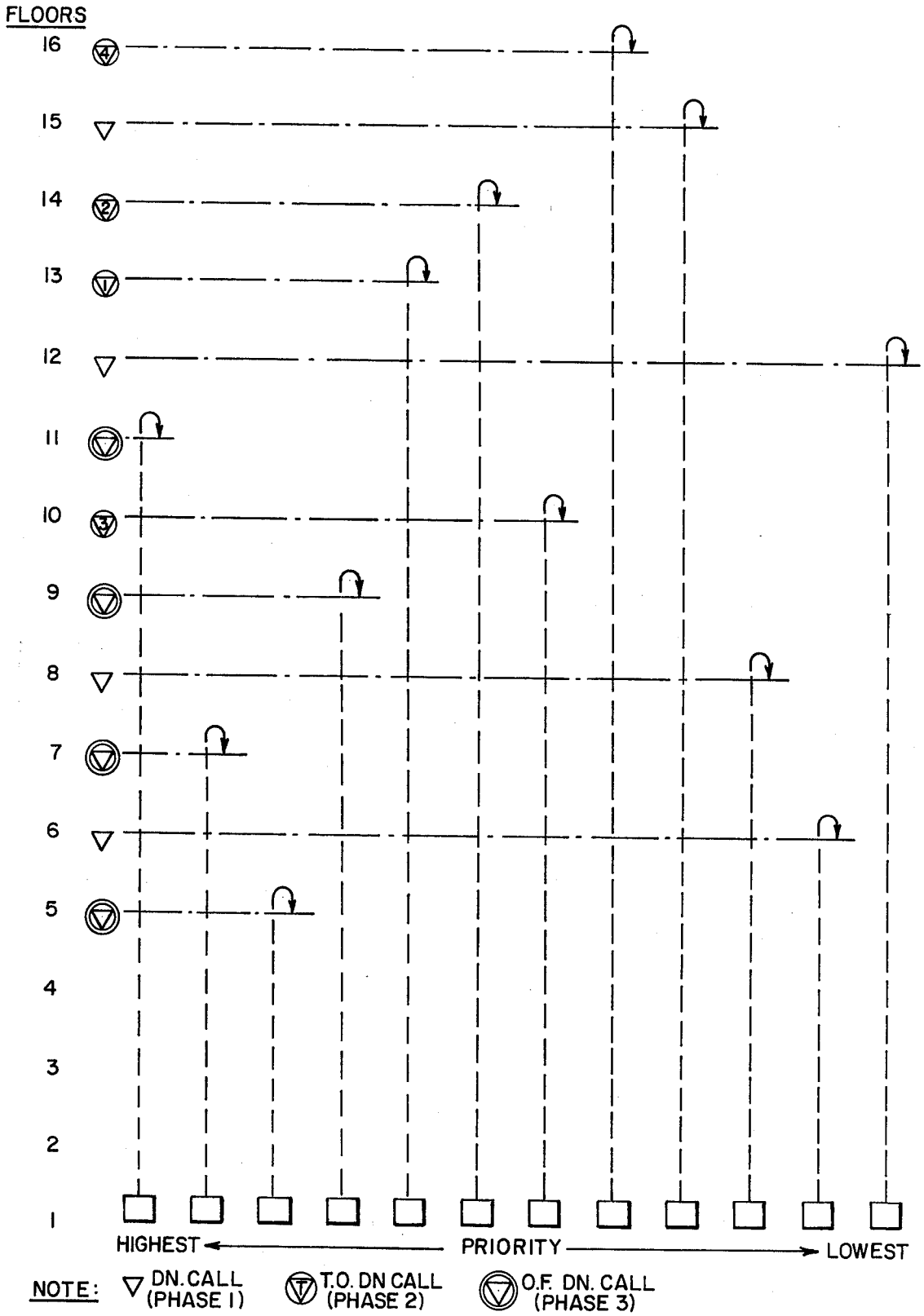
FIG. 4 is a chart which illustrates the priority levels in assigning available elevator cars to a plurality of down calls of different timed duration.

FIG. 4 is a chart which illustrates the priority sequence in assigning available cars to phase 1, phase 2 and phase 3 down calls in a 16 floor building having down calls registered at floors 5 through 16. Phase 1 down calls are indicated by a triangle, phase 2 down calls by a triangle within a single circle, and phase 3 down calls by a triangle within a double circle. The relative registration times of phase 2 calls are indicated by a number within the triangle, with the number indicating the longest registered phase 2 call.

The strategy first satisfies all phase 3 down calls, assigning the first available car to the highest of such calls at the eleventh floor. Since the remaining number of unassigned phase 3 calls is an odd number, the next car is assigned to the call at the midpoint of the remaining unassigned phase 3 down calls, which is the call at the seventh floor. The number of remaining calls is now an even number (2) and the calls are evenly divided into upper and lower groups. The lowest call of the upper group or the highest call of the lower group may be chosen for priority. In the example of FIG. 4, the highest call of the lower group is chosen, so the next available car is assigned to the phase 3 call at the fifth floor. This leaves only one unassigned phase 3 call, and the next available car is assigned to this call, which is at the ninth floor.

The strategy then satisfies all phase 2 down calls. The first available car for a phase 2 call is assigned to the longest registered of such calls, and thus a car is assigned to the phase 2 call at the thirteenth floor. This strategy of assigning available cars to the longest registered of the remaining calls continues, and thus available cars are assigned to the remaining phase 2 calls at the fourteenth, tenth and sixteenth floors, in the recited order.

The strategy then satisfies the phase 1 calls, assigning the first car available for phase 1 calls to the highest of such calls in the structure, which is the down call at the fifteenth floor. While the highest phase 1 call is in the assigned category, additional available cars are assigned to the midpoint of any remaining plurality of such calls, assigning cars to the calls at the eighth, sixth and twelfth floors, in the recited order, for the reasons set forth relative to the phase 3 strategy.

Figure 5A:
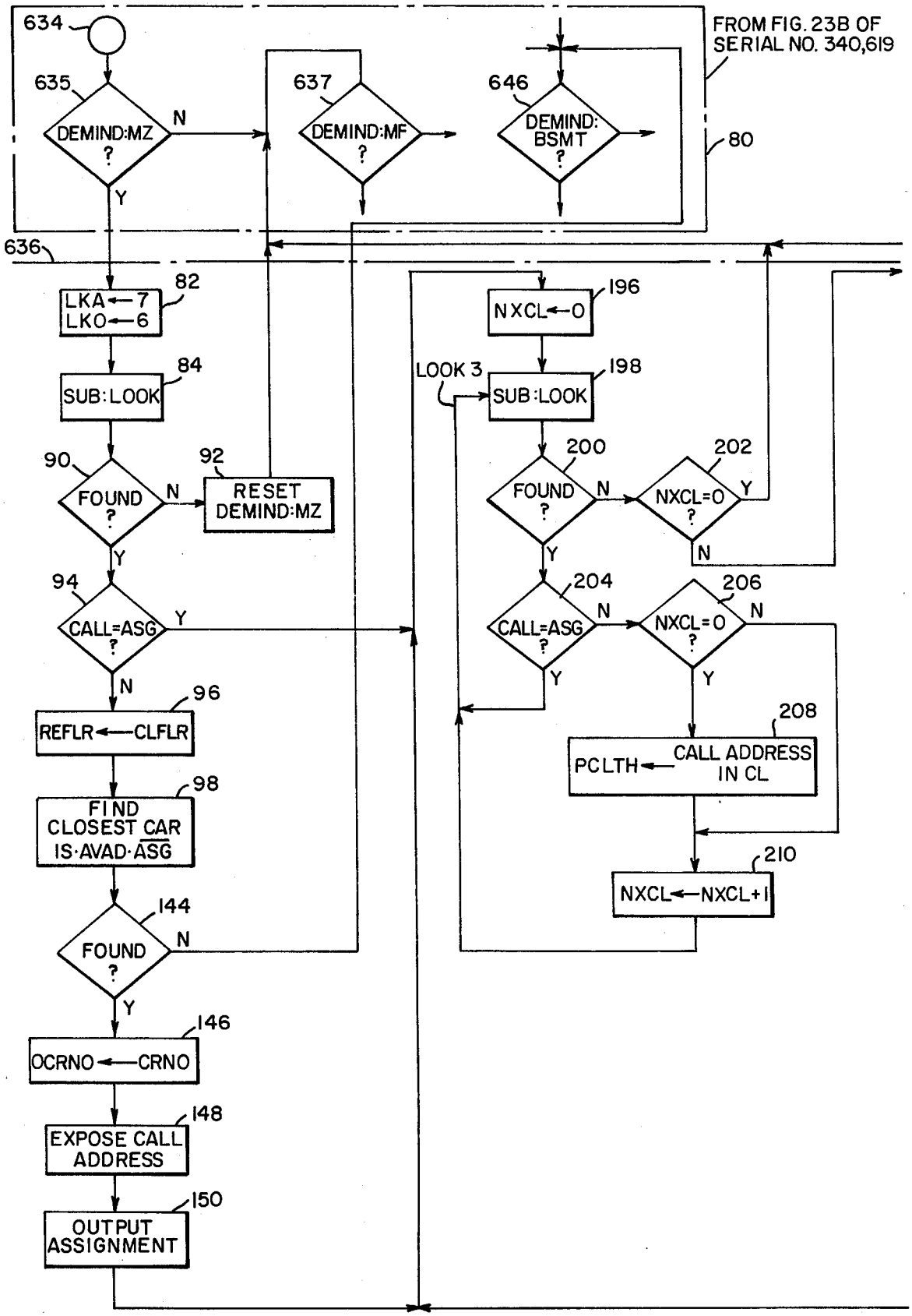
FIGS. 5A and 5B may be assembled to provide a flow chart of a subprogram which may be used to assign available cars to down demand floor calls which have been registered for less than a first predetermimed period of time.
Figure 5B:
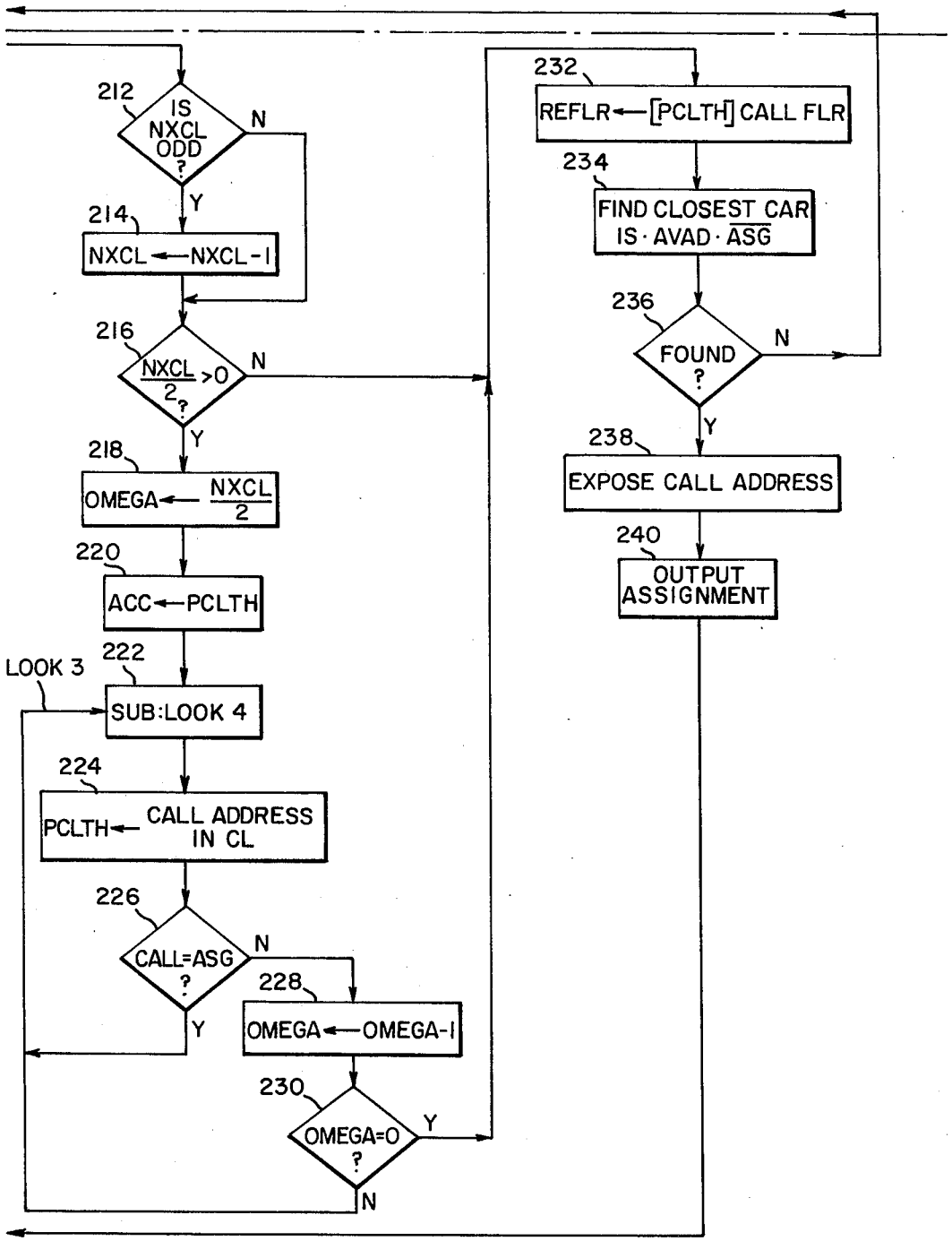

FIGS. 5A and 5B may be assembled to provide a detailed flow chart of a specific implementation of strategy for assigning available cars to phase 1 down demands. The flow charts shown in FIGS. 5A and 5B, as well as those of the remaining figures, are programmers flow charts and are of sufficient detail that a programmer of ordinary skill may write the programs in asembly language from these charts.

Program symbols used in FIGS. 5A and 5B, as well as in the remaining figures, which are not identified in the incorporated applications, are listed below:

| SYMBOL | DESCRIPTION |
|---|---|
| CLFLR | - The floor of the call being processed. |
| CLMCR | - The absolute difference between the floor number of a call to be assigned and the floor number of the ACP of an AVAD car being processed. |
| LNGCLT | - Variable used to store the longest registration time of phase 2 calls considered during the processing of the call table. |
| L0C4 | - Temporary storage address. |
| MEM | - A memory which is set to ONE when a phase 3 down call is found to have been previously assigned. |
| MϕUT0 | - Temporary storage location for constructing output word ϕW0. |
| MϕUT1 | - Temporary storage location for constructing output word ϕW1. |
| NRCR | - Variable used to indicate car number of closest AVAD car to call floor found so far. |
| NXCL | - Variable used to store the number of unassigned main zone down calls. |
| NXOFCL | - Variable used to store the number of phase 3 calls once the highest phase 3 call in the building is assigned. |
| O.F. | - OVER FLOWED - used to indicate a phase 3 call. |
| OMEGA | - The number of unassigned phase 1 or phase 3 calls, to reach the midpoint of such calls. |
| PCLTH | - Used to store call table address of certain calls. |
| PCLTHX | - Used to store call table address of highest unassigned phase 3 down call after the highest phase 3 down call has been assigned. |
| PK | - PARK |
| SDIF | - Variable used to store the number of floors BETWEEN the floor of a call to be assigned and the closest AVAD car found so far. |
| TCALL | - Variable used to store registration time of longest phase 2 call found so far. |

A down demand may be a single down call, or a down call from one or more floors of a zone. For purposes of example, each zone will be assumed to include only floor, and thus a down demand refers to a down call which could not be allocated by subprogram ACL to a busy car. FIGS. 5A and 5B are illustrated with a portion of FIG. 23B of incorporated application Ser. No. 340,619, in order to more clearly illustrate how the strategy may be applied to the elevator system disclosed in the hereinbefore mentioned U.S. Patent and the two applications, all incorporated by reference. The portion of application Ser. No. 340,619 shown in FIG. 5A is enclosed by the rectangle 80, with the reference numerals associated with the steps within the rectangle 80 being the same as those used in the incorporated application.

More specifically, if step 635 finds bit 6 of the demand word DEMIND set, indicating a down demand corridor call from a floor above the main floor, step 82 of the DEMIND main zone program 636 sets bit selection masks LKA and LKO equal to binary 7 and binary 6, respectively, which are then AND'ed and exclusive OR'ed in subroutine LOOK in step 84 to find a call of a certain type, and determine if the zone of this call matches the zone of the demand, i.e., zone 6 in this instance.

Figure 8:
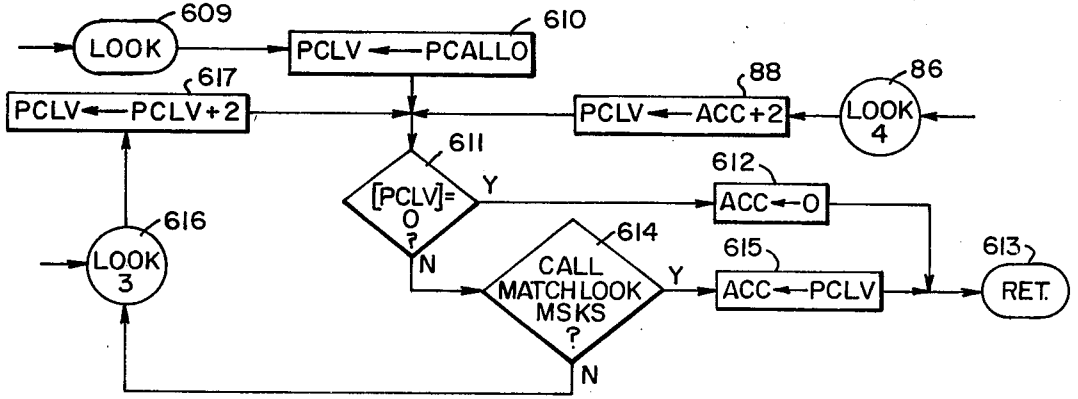
FIG. 8 is a flow chart of a subroutine LOOK which may be used in the subprograms shown in FIGS. 5A, 5B, 7A and 7B.

FIG. 8 is a flow chart of subroutine LOOK which may be used for step 84, which this subroutine being substantially the sme as that of FIG. 24 of the incorporated application Ser. No. 340,619, except for the additional entry terminal 86 and step 88. The reference numerals of the incorporated application are retained for those steps which are the same as those in the incorporated application.

Subroutine LOOK shown in FIG. 8 is entered at terminal 609. Step 610 sets the variale PCLV equal to the address of the first word in the call table (PCALLO). Since a previous step, step 605 of the incorporated application, ordered the call table, the first word of the call table will be associated with the highest call in the building, and it may be an up or down call. Step 611 checks the contents of PCLV. If the contents is zero, indicating no calls in the call table, step 612 then sets the accumulator to zero and returns to program ACR via terminal 613.

Figure 6:
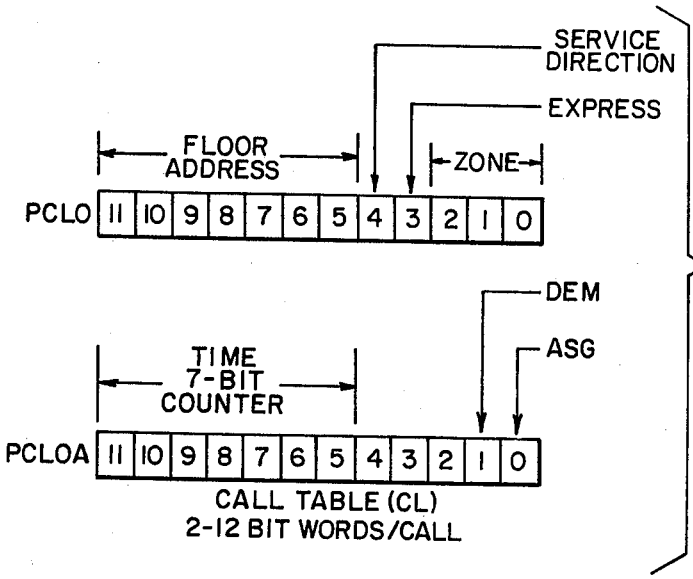
FIG. 6 is a diagrammatic representation of a call table illustrating the two words placed in the call table for each corridor call.

If the contents of address PCLV is not zero, step 614 checks to see if the call at address PCLV matches the LOOK masks. Since LKA was set to binary 7 in step 607, AND'ing a binary 7 with the first call word shown in FIG. 6 exposes bits 0, 1 and 2 of the first call word, which bits are used to identify the zone. LK0, set to binary 6, exclusive OR's binary 6 with the zone of the call. If they match, the call is a main zone down call and step 615 places this call word in the accumulator and returns to the FIG. 5A program via terminal 613. If the call is not a zone 6 call, for example it may be an up call, the program advances to terminal 616 and step 616. Step 617 sets PCLV equal to the address of the first word of the next call in the call table and returns to step 611. This cycling continues until either a zone 6 call is found, which is placed in the accumulator by step 615, or all calls are tested and no zone 6 call is found, which results in step 612 placing zeros in the accumulator.

Returning to FIG. 5A, step 90 checks to see if a zone 6 call was found. If not, the main zone demand is reset in step 92 and the program checks for a main floor demand in step 637. If a zone 6 call was found, it is tested to see if it has already been assigned. It will first be assumed that the call is not assigned. This call is the highest down call in the structure, since it is the first down demand call found in the call table, and the call table is processed from the top floor down. Step 96 makes the floor of this zone 6 call (CLFLR) the reference floor REFLR, for locating the closest available car to this floor. Step 98 looks for the closest car to this floor which is in service (IS), available according to the dispatcher or system processor (AVAD), and not assigned ($\overline{ASG}$). The subroutine shown in FIG. 9 may be used for finding the closest available car to the floor of the call, requested by step 98.

Figure 9:
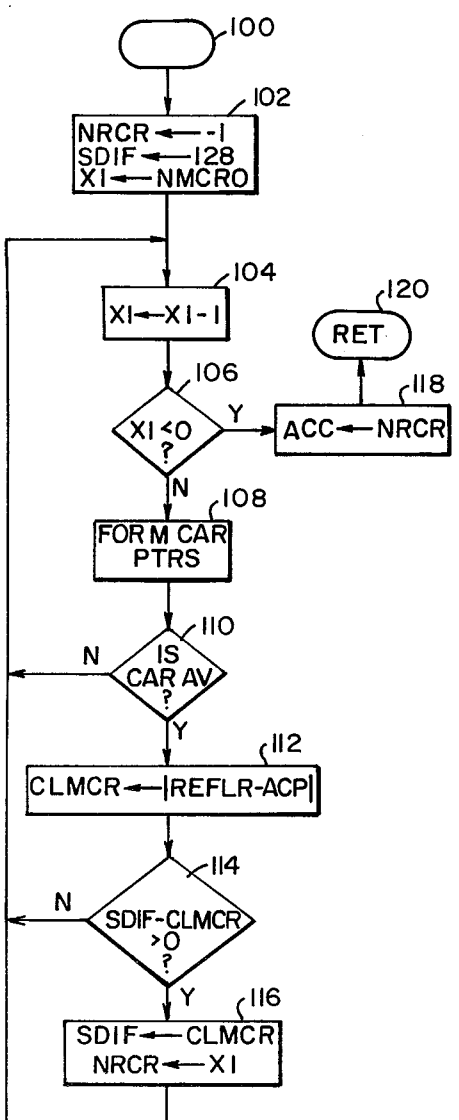
FIG. 9 is a flow chart of a subroutine for finding the closest available car to the floor of the call to be assigned.

The subroutine shown in FIG. 9 is entered at terminal 100, the variable NRCR is set to −1, the variable SDIF is set to 128, and the variable X1 is set to the number of cars in the system (NMCRO). When the processing of the cars has been completed, NRCR will be set to the car number of the closest availble car, and SDIF will be the number of floors between the floor of the call and this closest available car.

Step 104 subtracts 1 from X1. The cars are numbered starting with zero, and subtracting 1 from the number of cars in the system provides the number of the highest numbered car. Step 106 determines if 0 is greater than X1, which will not occur until all cars have been processed. Step 108 forms the address pointers which enable information to be extracted from the storage core which is associated with the car presently being considered. Step 110 determines if the car is available (AVAD). If it is not available for assignment, the program returns to step 104, X1 is decremented in step 106, and the address pointers for retrieving the information relative to this next lower numbered car are formed in step 108.

If step 110 finds the car is available, step 112 subtracts the advanced car position (ACP) from the floor of the down demand call (REFLR) and the absolute value of this difference is referred to as CLMCR. CLMCR represents the distance in floors the car presently being considered is from the call floor. Step 114 checks to see if the distance in floors of the closest car found so far from the call floor (SDIF) is a larger number than the distance in floors the car presently being considered is from the call floor. The CLMCR of the first available car to be considered will be less than 128, the number to which SDIF was set in step 102, so step 116 sets SDIF to the value of CLMCR for the car being considered Step 116 also sets NRCR to X1, so NRCR is the number of the closest AVAD car to the call floor found so far. If the car being considered is not as close to the call floor as a previously considered available car, step 116 is skipped, with step 114 proceeding back to step 104. When all cars have been considered, X1 will be negative and step 106 will advance to step 118. Step 118 places the number of the nearest available car to the call floor (NRCR) in the accumulator (ACC) and the program returns via terminal 120 to the point in the program where it exited to enter the subroutine.

Returning again to FIG. 5A, step 144 determines if step 98 found a car, i.e., is the number in the accumulator negative or positive? If no car was found, the program checks for a basement demand in step 646. If a car was found, step 146 sets OCRNO to the car number (CRNO) of the car found. OCRNO is the number of the car to which an assignment is to be made. Step 148 provides the binary address of the call floor, which will be output to the car as signal FAD0-FAD6, and step 150 outputs the car assignment. The subroutines shown in FIGS. 10 and 11 may be used to output the assignment to the car.

Figure 10:
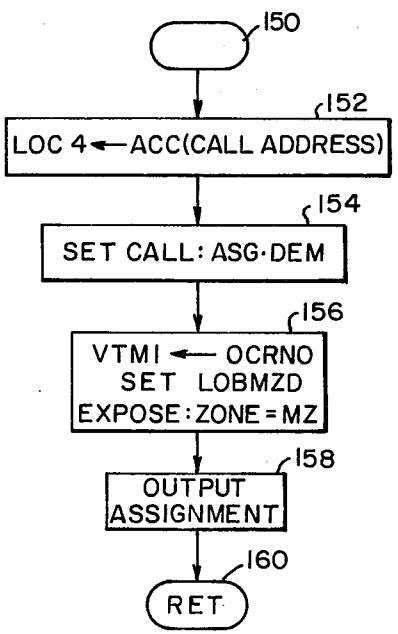

Referring to FIG. 10, the program enters the subroutine at terminal 150, and the address of the call which is in the accumulator is stored in the temporary storage location L0C4 in step 152. Step 154 sets the call assigned (ASG) and a demand (DEM). Step 156 sets the variable VTM1 to the number of the car (OCRNO), indicator LOBMZD is set to indicate that an available car has been assigned to a main zone down demand, and the main zone down (zone 6) is put into the accumulator. Step 158 outputs the assignment via the subroutine shown in FIG. 11, and returns to the main program via terminal 160.

Figure 11:
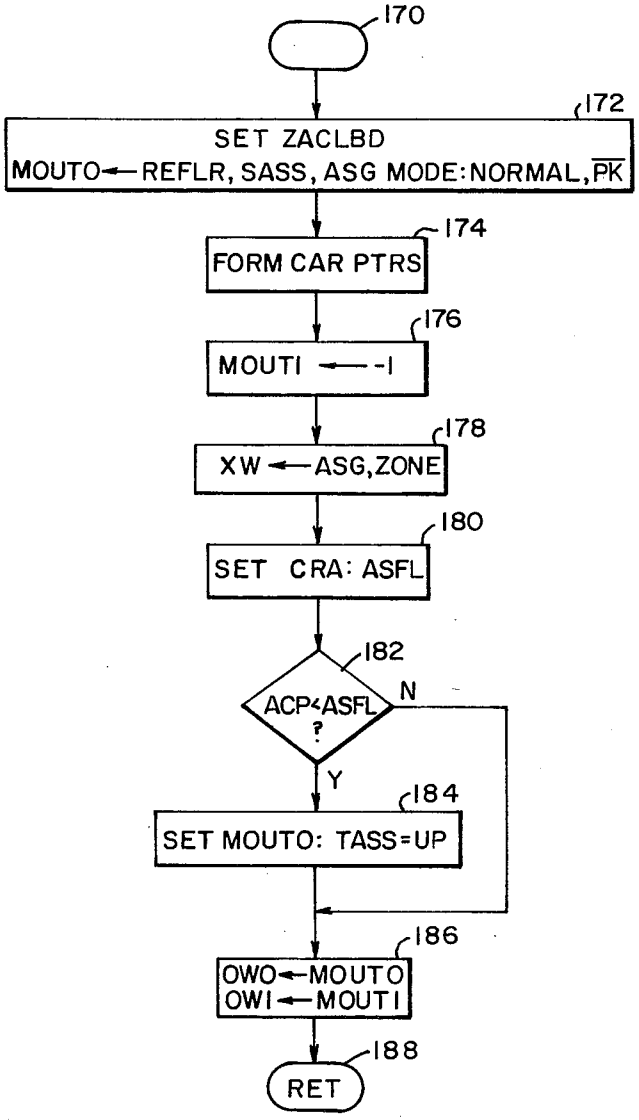
FIGS. 10 and 11 are flow charts of subroutines which may be used in preparing and sending an assignment to an elevator car.

The subroutine shown in FIG. 11, which was called up in step 158 of the subroutine shown in FIG. 10, is entered via terminal 170. Step 172 sets the indicator ZACLBD, to request subprogram ACL to reprocess all calls in the call table CL. All the calls in the call table are reprocessed during the next running of subprogram ACL, because there is now a new car in operation. Step 172 now starts to build an assignment word in temporary location M0UTO, which will eventually be output word 0WO for this selected car. Step 172 places the address (FAD0-FAD6) of the call floor (REFLR) into this word, sets the service assignment direction (SASS), the assignment mode is set to normal, i.e., M0D1 and MODO are 0 and 1, respectively, which enables the elevator car to see only the call at the reference floor (REFLR), and the car is not set for parking ($\overline{PK}$). Step 174 forms the car address pointers for extracting information relative to the car in question from the storage core. Step 176 sets all of the bits in temporary word M0UT1 to "ones". Word M0UT1 will become output word OW1 for the car in question, and by setting all of the bits of this word to one, it sets the hall lanterns and doors for normal operation, no car calls are inhibited ($\overline{CCAI}$), there is no master reset of calls ($\overline{MCCR}$), and the car is not set for basement service ($\overline{BSMT}$). Step 178 puts the assigned zone (zone 6) into the extra memory word (XW) for the selected car. The assignment register CRA has a bit set which corresponds to the assigned floor (ASFL), in step 180. Step 182 determines where the advanced car position (ACP) of the car is relative to the assigned floor (ASFL). If the assigned floor is below the car, the travel direction will be down and nothing need be done to the travel direction bit TASS, since it is initially set to 0, corresponding to down. If the assigned floor is above the car, step 184 sets the travel direction bit TASS to a one, to correspond to "UP", in the temporary word location M0UTO. Step 186 then sets output word 0W0 to correspond to temporary word M0UT0 and output word 0W1 to correspond to temporary word M0UT1, which words are periodically sent to the car in question. The subroutine returns to the program via terminal 188.

Returning now to FIG. 5A, if step 94 found that the call was already assigned, the program advances to step 196. The first down call found will be the highest phase 1 down call in the structure since the calls are ordered as to location, starting with the top of the structure. If it is already assigned, the phase 1 strategy continues, with step 196 setting the variable NXCL to zero. NXCL will eventually be equal to the number of unassigned main zone down calls. Step 198 enters terminal 609 of subroutine LOOK (FIG. 8), as hereinbefore described, to find a main zone down call. Step 200 determines if a call was found. If no call was found, step 202 determines if any unassigned main zone calls had been found. If no such calls were found, the program checks another demand category in step 637. If step 200 found a call, step 204 determines if the call is assigned. If the call is assigned, the program goes back to step 198, entering terminal 616 of subroutine LOOK to examine the first word of the next call in the call table, as only unassigned calls are being counted. If step 204 finds that the call is not assigned, step 206 determines if this is the first unassigned down call found by asking if NXCL is equal to zero. If it is equal to zero, this is the first unassigned down call found and the variable PCLTH is set to the address of this call in the call table CL, in step 208. If this is not the first unassigned down call found, NXCL will not be zero and step 208 is skipped. In either event, step 210 adds one to NXCL and the program returns to step 198 to process the next call in the call table.

When all of the calls have been processed, step 200 will not find a call and NXCL will be equal to the number of unassigned down calls. Step 202 will find that NXCL is not zero, assuming there is at least one unassigned down call, and step 212 determines if NXCL is an odd number. If it is an odd number, step 214 substracts one from NXCL in order to make it an even number, and step 216 divides NXCL by two and asks if the result is greater than zero. If NXCL was an even number to start with, step 214 is skipped. If one-half of NXCL is not greater than zero, it indicates only one unassigned down call was found and thus this is the call which an available car should be assigned to. If one-half of NXCL is greater than zero, step 218 sets the variable OMEGA equal to NXCL divided by 2. Thus, OMEGA is the number of calls from the call table address of the highest unassigned down call in the building (PCLTH), to the midpoint of such unassigned down calls. Step 220 places the call table address (PCLTH) of this highest unassigned down call in the accumulator, and step 222 enters the subroutine LOOK shown in FIG. 8 at terminal 86. Subroutine LOOK, via step 88, finds the next down call from this highest unassigned down call and places it in the accumulator, and step 224 sets PCLTH to the call table address of this next down call. Step 226 determines if this next down call is assigned, and if so the program returns to step 222, entering subroutine LOOK at terminal 616 (FIG. 8), to find the address of the next down call. If step 226 determines that the call is not assigned, step 228 sets OMEGA equal to OMEGA minus one. Step 230 checks to see if this makes OMEGA zero. If it does not, this call is not the midpoint call and the program returns to step 222, entering subroutine LOOK via input 616 to find the next unassigned down call via step 222, 224 and 226. When step 230 finds that OMEGA is zero, this particular call is the call which represents the midpoint of an odd numbered plurality of calls, or the highest call of the lower of two equal groups of calls.

When the midpoint call is found, as determined by step 230, or if only one unassigned down call was found, as determined by step 216, the program advances to step 232 which sets the reference floor REFLR equal to the contents of the call table address PCLTH, with the contents of this call table address i.e., the first call word, identifying the floor address of the call. Step 234 attempts to locate the closest availble car, such as by the subroutine shown in FIG. 9, and hereinbefore described. If no car is found, as determined in step 236, the program goes to the next demand at step 637. If a car is found, the call address is exposed (i.e., placed in the accumulator) in step 238, and step 240 outputs the assignment such as by the subroutines shown in FIGS. 11 and 12, and hereinbefore described. After the assignment is given, the program may return to step 196 to determine if there are any further unassigned down calls, as hereinbefore described.

Figure 7A:
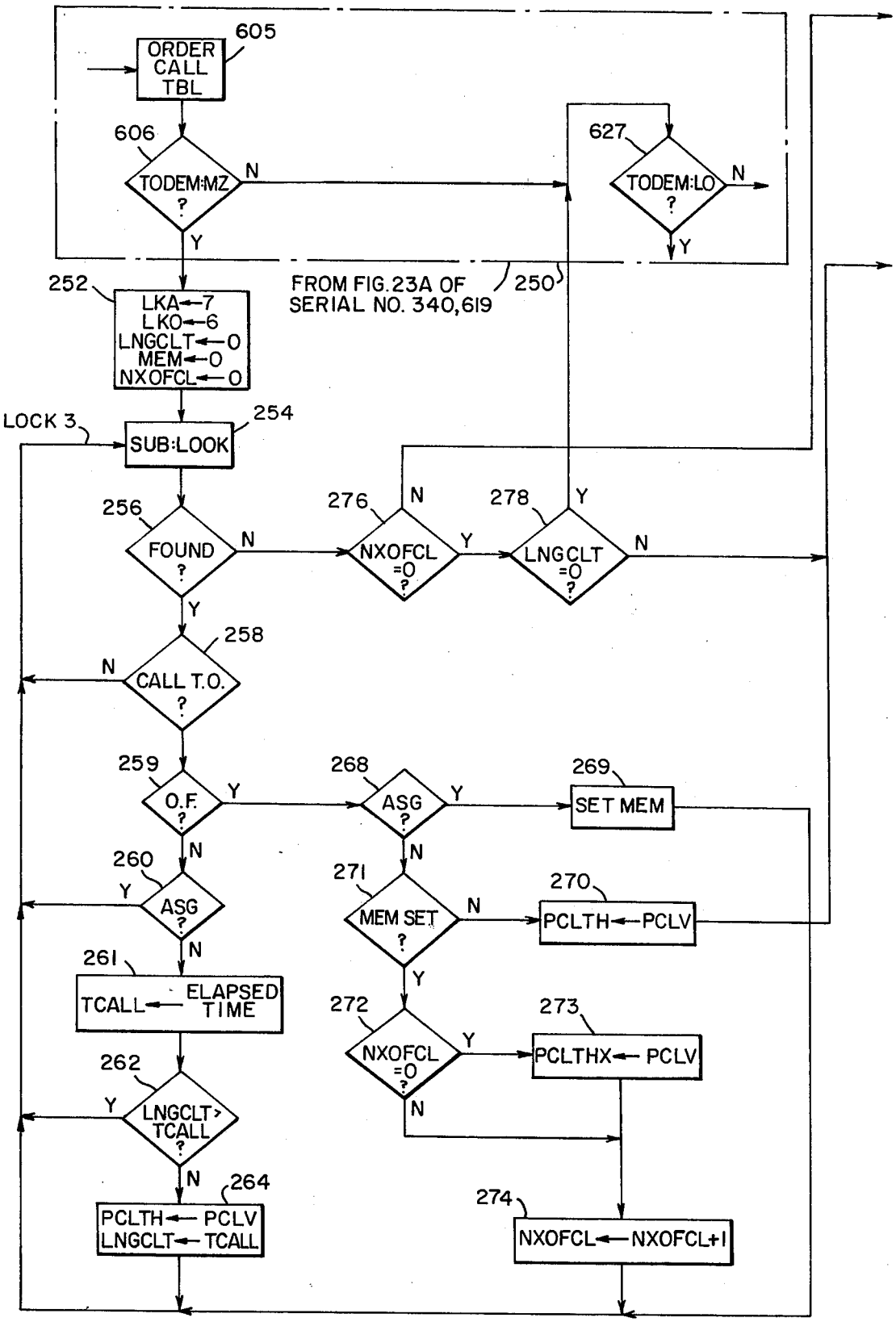
FIG. 7A and 7B may be assembled to provide a flow chart of a subprogram which may be used to assign available cars to down demand floor calls which have been registered for more than a first predetermined period of time, and also for those registered for a second predetermined period of time.
Figure 7B:
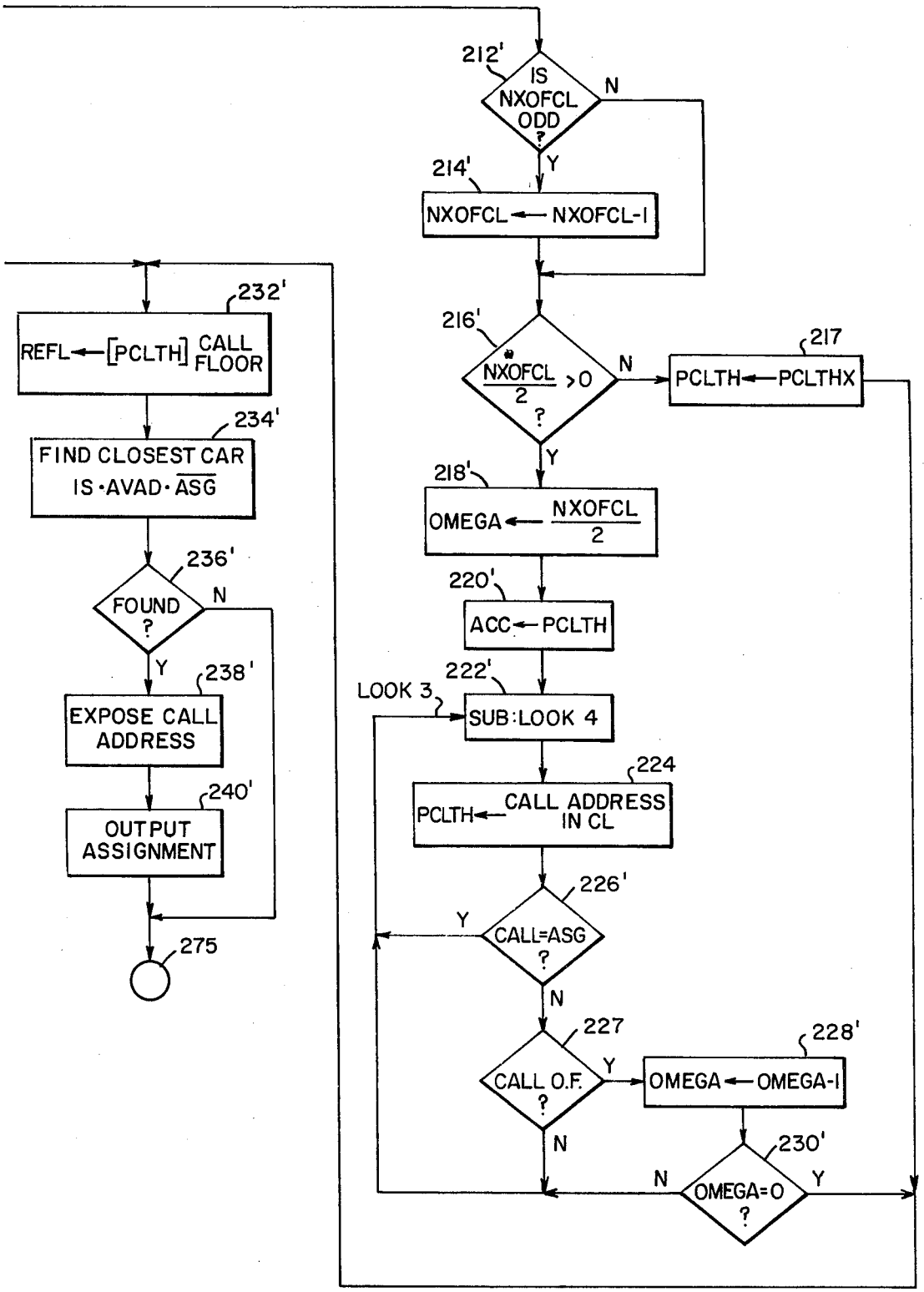

FIGS. 7A and 7B may be assembled to provide a detailed flow chart of a specific implementation of strategy for assigning available cars to phase 2 and phase 3 down demands. The steps within the rectangle 250 are from FIG. 23A of the incorporated application Ser. No. 340,619 with the reference numerals associated with these steps being the same as in this incorporated application. Step 605 places the calls in order in the call table such that the call at the top of the table is the highest call in the structure, and the remaining calls are from successively lower floors. When step 606 finds a timed out demand (TODEM) in the main zone down (MZ) by finding bit 6 of the timed out demand word (TODEM) set, step 252 sets bit selection masks LKA and LKO to binary 7 and binary 6, respectively, for the purposes hereinbefore described relative to step 82 in FIG. 5A. Step 252 also sets the variables LNGCLT and NXOFCL to zero, as well as a memory MEM. The variable LNGCLT will contain the time of the longest registered phase 2 down call found so far as the timed out down calls are processed, and will contain the time of the longest registered phase 2 down call when all of the timed out down calls have been processed. The variable NXOFCL will contain the number of unassigned phase 3 down calls when all calls have been processed. The memory MEM is set to ONE when the highest phase 3 down call in the structure is found to already have a car assigned thereto. Step 254 enters terminal 609 of the subroutine LOOK shown in FIG. 8, and this subroutine starts at the top of the call table and places the address of the first word of the first down call it finds in the accumulator, as hereinbefore described. Step 256 checks to see if the subroutine LOOK found a down call, and if it did, step 258 checks to see if the call has timed out, i.e., registered for at least the first predetermined period of time. If the down call is not timed out it is not a phase 2 or a phase 3 call, and the program returns to subroutine LOOK of FIG. 8, entering terminal 616 thereof, to locate the next lower down call in the building. If the down call is timed out, step 259 determines if the call is a phase 3 call. It will first be assumed that there are not phase 3 calls in the call table. The program then advances to step 260. Step 260 determines if the call has a car specifically assigned to answer it. If it is an assigned call, the program returns to terminal 616 of subroutine LOOK in step 254, to find the next lower down call. If the call is not an assigned call, step 261 sets the variable TCALL to the elapsed time of this down call. Step 262 checks to see if the elapsed time of the longest call found so far LNGCLT is greater than TCALL. Since LNGCLT was set to zero, the first timed out call found will necessarily be greater, (or more negative, if a decrementing arrangement is used), and step 264 sets LNGCLT to the value of TCALL, and also sets the variable PCLTH to the address of this call in the call table CL (PCLV). When all of the timed out down calls have been processed, LNGCLT will be equal to the elapsed time of the longest registered down call in the building, and PCLTH will be the address of this call in the call table.

It will now be assumed that there is at least one phase 3 call in the call table. As soon as the phase 3 call is found by step 259, the loop which functions to locate the longest registered phase 2 call in the call table is interrupted and step 268 determines if this phase 3 call already has a car assigned thereto. The first phase 3 down call found is automatically identified as the highest phase 3 down call in the building, since the ordered call table is processed from the top floor down. If it already has a car assigned thereto, the memory MEM is set to ONE to identify the fact that the highest phase 3 down call is an assigned call, and the program returns to step 254, entering terminal 616 of subroutine LOOK to continue the processing of the call table.

If the phase 3 call considered in step 268 is not an assigned call, step 271 checks to see if MEM is set. If MEM is not set, this call is the highest phase 3 down call in the structure, and step 270 sets PCLTH to the address PCLV of this call in the call table. Steps 232' through 240' immediately attempt to assign an available car to this call, as hereinbefore described relative to steps 232 through 240 in FIG. 5B. The program returns to the priority executive, following step 240', exiting via terminal 275.

If the call is assigned to an available car, and it still appears as an assigned call the next time the call table is processed, MEM will be set for this call during this next running of the program. Since the program cycle time is short the call will usually not be answered before the program runs again, unless the assigned car was in position to answer the call when it was assigned.

If the phase 3 call is not assigned and MEM is set, step 272 determines if this is the only assigned phase 3 down call in the building by checking to see if the variable NXOFCL is zero. NXOFCL was set to zero in step 252, and if it is still zero, the call is the highest unassigned phase 3 down call and its address PCLV in the call table CL is "remembered" by setting the variable PCLTHX to this address in step 273. Step 274 increments the variable NXOFCL by one, to count this unassigned phase 3 down call, and the program returns to step 254 to find the next down call.

When all of the calls have been processed, the variable NOXFCL will be equal to the number of unassigned phase 3 down calls in the call table, and PCLTHX will contain the call table address of the highest of such calls in the structure. The variable LNGCLT will contain the time of the longest registered phase 2 down call in the call table and PLCTH will contain the call table address of this call.

When all calls have been processed, step 256 will proceed to step 276. Step 276 determines if any unassigned phase 3 down calls were found. If no unassigned phase 3 down calls were found, step 278 determines if any phase 2 calls were found. If no phase 3 or phase 2 calls were found, the program may proceed to step 627, to check another demand category.

If NXOFCL is zero but LNGCLT is not zero, step 278 advances to step 232' to attempt to assign an available car to the longest registered phase 2 call.

If the highest phase 3 down call is an assigned call, and an unassigned phase 3 down call was found, the variable NXOFCL will not be zero and the program advances from step 276 to step 212', to further implement the phase 3 call strategy.

Step 212' checks to determine if the number of phase 3 calls is odd or even, and step 214' provides an even number of phase 3 calls when the number is odd. Step 216' determines if there is more than one phase 3 call. If there is only one, step 217 sets PCLTH to the addres PCLTHX of this call and the program advances to step 232' to attempt to assign an available car to this call. If there is more than one phase 3 call, step 218' sets up the number of calls from the highest unassigned phase 3 down call to the midpoint of such calls. Steps 220', 222', 224' and 226' search the call table for unassigned down calls and step 227 is added to extend the search to only phase 3 calls. The phase 3 calls are counted in step 228' and step 230' determines when the midpoint call is reached. Steps 232' through 240' then assign the closest available car to the floor of this selected midpoint call, as hereinbefore described.

In summary, there has been disclosed a new and improved elevator system, and method of assigning calls to cars in an elevator system, which provide more equitable priority service to all of the floors of a building based upon the registration times of the calls, as well as the locations of the calls in the structure, and the locations of the calls relative to one another. A first predetermined strategy for assigning cars to calls, based on call location in the building, and the location of a call relative to the other calls in the building, is used until one or more calls times out. The calls are timed, even after timing out, and the strategy changes from a call location basis to a total registration time basis, assigning cars to timed out calls based upon the relative registration times of the calls. Should the traffic situation be so unusual that one or more calls are registered for a second predetermined period of time, after which timing of such a call, or calls, is discontinued, the strategy for assigning cars to these calls is again changed, assigning cars to these calls according to the locations of these calls in the building, and the locations of the calls relative to one another.

We claim as our invention:

1. An elevator system for a structure having a plurality of floors, comprising:

a plurality of elevator cars, means mounting said elevator cars for movement relative to the structure to serve the floors, means for registering calls for elevator service for at least a predetermined direction from certain of said floors, means canceling said calls for elevator service in response to predetermined conditions, timing means recording the registration times of at least certain of the calls, first indicating means identifying calls registered for a first predetermined period of time, said timing means continuing to record the registration times of calls after they have been registered for the first predetermined period of time, at least until the calls have been registered for a second predetermined period of time, second indicating means identifying calls registered for the second predetermined period of time, and assignment means responsive to said calls for elevator service and to said first and second indicating means, said assignment means assigning elevator cars to serve at least certain of the calls according to a predetermined first strategy until said first indicating means indicates at least one of the calls has been registered for the first predetermined period of time, said assignment means assigning elevator cars to serve those calls registered for the first predetermined period of time according to a second predetermined strategy, at least until the second indicating means indicates at least one of the calls has been registered for the second predetermined period of time, said assignment means assigning elevator cars to serve those calls registered for the second predetermined period of time according to a third predetermined strategy, which differs from the second predetermined strategy.

2. The elevator system of claim 1 wherein the assignment means includes means for assigning an elevator car to the highest call in the structure of those calls registered for the second predetermined period of time, and means providing for any additional such calls prior to the canceling of such assigned highest call, by successively assigning cars to such a call located intermediate the highest and lowest of such unassigned calls in the structure.

3. The elevator system of claim 1 wherein the assignment means includes means for assigning an elevator car to the highest call in the structure of those calls registered for the second predetermined period of time, and means providing for additional such calls prior to the canceling of such assigned highest call, by successively assigning an elevator car to the middle of such remaining unassigned calls in the structure when the number of such calls is an odd number plurality, and to a call adjacent the middle of such remaining unassigned calls in the structure when the number of such calls is an even number.

4. The elevator system of claim 3 wherein the assignment means, when assigning a car to a call adjacent the middle of an even number of unassigned calls registered for the second predetermined period of time, selects the highest call of the lower half of such calls.

5. The elevator system of claim 3 wherein the assignment means, when assigning a car to a call adjacent the middle of an even number of unassigned cars registered for the second predetermined period of time, selects the the lowest call of the upper half of such calls.

6. The elevator system of claim 1 wherein the assignment means includes means for assigning elevator cars to the longest registered of those calls registered for the first predetermined period of time, until a call is registered for the second predetermined period of time, at which time the assignment means changes to the third predetermined strategy which includes assigning a car to the highest call in the structure which has been registered for the second predetermined period of time.

7. The elevator system of claim 6 wherein the assignment means includes means for locating the longest registered of those calls registered for at least the first predetermined period of time by checking the total registration times of such calls, starting with the highest of such calls in the structure, and replacing this highest call with a lower of such calls only when the lower of such calls has been registered for a longer period of time, and means assigning a car to the call finely selected after this successive checking of such calls.

8. The elevator system of claim 6 wherein the assignment means after the highest of a plurality of calls registered for the second predetermined period of time has been assigned to a car, successively assigns cars to the remaining of such unassigned calls registered for the second predetermined period of time by first selecting calls intermediate the highest and lowest of such remaining calls.

9. The elevator system of claim 1 wherein the assignment means includes means assigning cars to calls according to the first predetermined strategy when no calls have been registered for the first predetemined period of time, means for assigning cars to calls according to the second predetermined strategy only when at least one call has been registered for the first predetermined period of time, and means assigning cars to calls according to the third strategy only when at least one call has been registered for the second predetermined period of time.

10. The elevator system of claim 1 wherein the first and third predetermined strategies of the assignment means assigns cars to calls according to the locations of the calls in the structure, and the locations of the calls relative to one another, and the second predetermined strategy of the assignment means assigns cars to calls according to the registration times of the calls.

11. An elevator system for a structure having a plurality of floors, comprising:

a plurality of elevator cars, means mounting said elevator cars for movement relative to the structure to serve the floors, means for registering calls for elevator service for at least a predetermined direction from each of a predetermined plurality of the floors, means canceling registered calls for service in response to predetermined conditions, timing means for recording the registration times of at least certain of the calls, first indicating means identifying calls registered for a first predetermined period of time, said timing means continuing to record the registration times of calls after they have been registered for the first predetermined period of time, at least until the calls have been registered for a second predetermined period of time, second indicating means identifying calls registered for the second predetermined period of time, and assignment means responsive to said second indicating means, said assignment means assigning an elevator car to the highest call in the structure registered for the second predetermined period of time, said assignment means, prior to the canceling of such assigned highest call, providing for additional calls registered for the second predetermined period of time by successively assigning cars to such a call which is located intermediate the uppermost and lowermost of such remaining unassigned calls.

12. The elevator system of claim 11 wherein the assignment means assigns a car to the call located at the midpoint of the remaining unassigned calls registered for the second predetermined period of time when the number of such calls is an odd number, and to the highest call of the lower half of such calls when the number of such calls is an even number.

13. The elevator system of claim 11 wherein the assignment means assigns a car to a call located at the midpoint of the remaining unassigned calls registered for the second predetermined period of time when the number of such calls is an odd number, and to the lowest call of the upper half of such calls when the number of such calls is an even number.

14. The elevator system of claim 11 wherein the timing means includes binary counters, with the second predetermined period of time being indicated when a binary counter counts to overflow.

15. The elevator system of claim 11 wherein the assignment means is responsive to the first indicating means, said assignment means successively assigning elevator cars to the longest registered unassigned calls of those calls registered for the first predetermined period of time.

16. The elevator system of claim 11 wherein the assignment means is responsive to the first indicating means, assigning cars to calls according to a first predetermined strategy until the first indicating means indicates at least one call has been registered for the first predetermined period of time, at which time the assigning means assigns cars to calls registered for the first predetermined period of time according to a second predetermined strategy.

17. The elevator system of claim 16 wherein the assignment means successively assigns cars to the longest registered unassigned call of those calls registered for the first predetermined period of time.

18. An elevator system for a structure having a plurality of floors, comprising:

a plurality of elevator cars, means mounting said elevator cars for movement relative to the structure to serve the floors, means for registering calls for elevator service for at least a predetermined direction from each of a predetermined plurality of the floors, means canceling registered calls for service in response to predetermined conditions, timing means for recording the registration times of at least certain of the calls, first indicating means identifying calls registered for a first predetermined period of time, said timing means continuing to record the registration times of calls after they are registered for the first predetermined period of time, at least until the calls have been registered for a second predetermined period of time, second indicating means identifying calls registered for the second predetermined period of time, and assignment means responsive to said first and second indicating means, assigning an elevator car to the longest registered of the calls registered for the first predetermined period of time, said assignment means including means for comparing the times of such calls, starting with the highest of such calls in the structure, assigning the elevator car to the longest registered call in the event no calls have reached the second predetermined period of time.

19. The elevator system of claim 18 wherein the assignment means is responsive to the second indicating means assigning a car to the highest call in the structure which has been registered for the second predetermined period of time, said assignment means, prior to the cancellation of an assigned highest call registered for the second predetermined period of time, providing for any additional calls registered for the second predetermined period of time by successively assigning cars to the call which is at or adjacent to the midpoint of such remaining unassigned calls.

20. A method of assigning calls from a plurality of floors of a structure to a plurality of elevator cars mounted in the structure to serve the floors, comprising the steps of:

providing means for registering floor calls from the plurality of floors of the structure, timing each floor call, providing means for canceling the floor calls in response to predetermined conditions, indicating when each call has been registered for a first predetermined period of time, continuing the timing of each call after it has been registered for the first predetermined period of time, indicating when each call has been registered for a second predetermined period of time, assigning cars to unassigned calls according to a first predetermined strategy based on call location when none of the calls have been registered for the first predetermined period of time, according to a second predetermined strategy based on registration time when at least one call has been registered for the first predetermined period of time, and according to a third predetermined strategy based on call location when at least one call has been registered for the second predetermined period of time.

21. The method of claim 20 including the step of allocating a floor call to a suitably conditioned elevator car already busy serving calls for elevator service, with the step of assigning cars to unassigned calls assigning cars to only those calls which could not be allocated to a suitably conditioned busy car.

22. The method of claim 20 including the steps of determining when a car is available for accepting a specific assignment, with the step of assigning cars to unassigned calls assigning only those cars found to be available for assignment.

23. The method of claim 20 including the steps of allocating a floor call to a suitably conditioned elevator car already busy serving calls for elevator service, and determining when a car is available for accepting a specific assignment, with the step of assigning elevator cars assigning only those cars found to be available, and only to those calls which could not be allocated to a suitably conditioned busy car.

* * * * *